US005461781A

United States Patent [19]

Pirc

[11] Patent Number: 5,461,781

[45] Date of Patent: Oct. 31, 1995

[54] DYNAMIC SHAVING SYSTEM WITH INTEGRAL PUSH CLEAN BAR AND SPRING MEMBER

[75] Inventor: Douglas J. Pirc, Orange, Conn.

[73] Assignee: Warner-Lambert Company, Morris Plains, N.J.

[21] Appl. No.: 270,075

[22] Filed: Jul. 1, 1994

[51] Int. Cl.[6] ..... B26B 21/22

[52] U.S. Cl. ..... 30/41; 30/50

[58] Field of Search ..... 30/41, 41.5, 50, 30/61, 62, 63

[56] References Cited

U.S. PATENT DOCUMENTS

| | | | |
|---|---|---|---|
| 4,047,296 | 9/1977 | Ishida et al. | 30/41 |
| 4,205,437 | 6/1980 | Chen et al. | 30/41 |
| 4,257,160 | 3/1981 | Murai | 30/41 |
| 4,300,285 | 11/1981 | Endo | 30/63 |
| 4,395,822 | 8/1983 | Ciaffone | 30/41 |
| 5,251,376 | 10/1993 | Althaus et al. | 30/50 |
| 5,276,967 | 1/1994 | Ferraro et al. | 30/49 |

FOREIGN PATENT DOCUMENTS

| | | | |
|---|---|---|---|
| 1094306 | 1/1981 | Canada | 30/41 |
| 0287387 | 10/1988 | European Pat. Off. | 30/41 |
| 52-22791 | 2/1977 | Japan | 30/41 |

*Primary Examiner*—Hwei-Siu Payer
*Attorney, Agent, or Firm*—Charles W. Almer, III

[57] ABSTRACT

A razor head comprising at least one movable skin-engaging element which moves in response to forces encountered during shaving and a cleaning member for selectively dislodging shaving debris from small spaces on the razor head. A pair of resilient, spring fingers are integrally formed with the cleaning member for biasing the skin-engaging element. The cleaning member is provided with an actuator button to allow a person shaving to move the cleaning member forwardly to dislodge shaving debris.

15 Claims, 3 Drawing Sheets

DYNAMIC SHAVING SYSTEM WITH INTEGRAL PUSH CLEAN BAR AND SPRING MEMBER

The present invention is directed to a dynamic shaving system and, more particularly, to a dynamic shaving system having a biased cleaning member for dislodging shaving debris from the shaving system.

BACKGROUND OF THE INVENTION

A common problem encountered by wet safety razors is the accumulation of shaving debris between skin-engaging elements of the razor head. In recent times, most safety razors sold on the market are manufactured with two blades disposed in spaced relation. Typically, a guard member is positioned forwardly of the leading blade at a fixed distance from the leading blade in order to control the angle at which the skin surface being shaved contacts the leading blade. The size of the space between the two blades will also affect the flow of skin over the cutting edges and, therefore, needs to be carefully controlled during the manufacture of the razor head. The accumulation of whiskers, soap, skin cells and other shaving debris in any of these small spaces poses the potential for altering the flow of skin across the sharpened blade edges and adversely affecting the comfort and closeness of the shave.

It is therefore highly desirable to provide a mechanism for the selective removable of shaving debris from spaces defined by skin-engaging elements of a razor head.

Recent changes in razor head design have lead to the marketing of razor heads having movable blade members. Though various elements of razor head may move relative to one another, they will not necessarily remove shaving debris which can adversely affect the overall quality of the shave. It is therefore also desirable to provide a razor head having at least one and preferably at least two movable blades with a cleaning member capable of removing shaving debris from between the movable blades.

It is also highly desirable to provide a simple design with a minimum number of pieces in order to facilitate quick and inexpensive manufacture of the subject razor head. Specifically, it would be desirable to eliminate the need for separately forming biasing members intended to return movable skin-engaging elements to their original positions after the forces encountered during shaving are removed.

These and other advantages are accomplished by the embodiments of the present invention which are described in further detail below with reference to the drawings.

SUMMARY OF THE INVENTION

The present invention is directed to a razor head comprising at least one movable blade which moves in response to forces encountered during shaving. According to one embodiment, an integrally formed cleaning member is provided for selectively dislodging shaving debris from small spaces adjacent a movable blade and for biasing the movable blade in order to return the movable blade to a normal "home" position after shaving forces are removed.

According to one preferred embodiment of the present invention, a razor head is provided with at least two movable blades which are each biased forwardly by a pair of resilient, spring fingers which are integrally formed with the cleaning member. According to this embodiment, the cleaning member is provided with an actuator button connected to a forward projection to allow a person shaving to move the cleaning member forwardly to dislodge shaving debris, and a plurality of resilient fingers above and below the forward projection for contact with the movable blades. The cleaning member advantageously serves the dual purpose of returning the forward projection of the cleaning member back to a retracted position after the person shaving removes pressure from the actuator, while also urging the blades forwardly.

The present invention advantageously reduces the number of separate elements that must be manufactured and then assembled, while providing the benefits of a dynamic shaving system which allows a user to selectively remove shaving debris that becomes lodged in spaces of the razor head.

These and other aspects of the present invention are described in further detail herein.

DETAILED DESCRIPTION OF THE PREFERRED EMBODIMENTS

Figure 1:
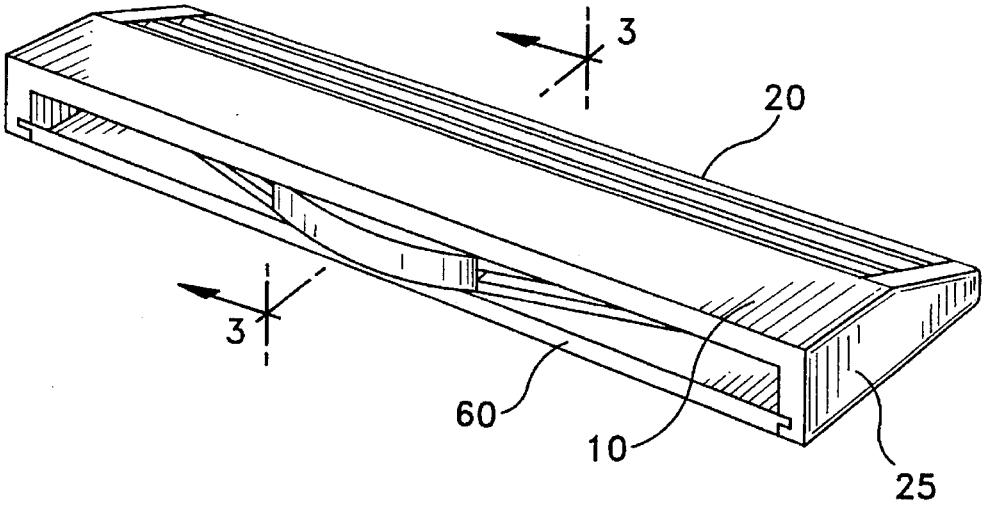
FIG. 1 is an perspective view of a razor head of one embodiment of the present invention.
Figure 2:
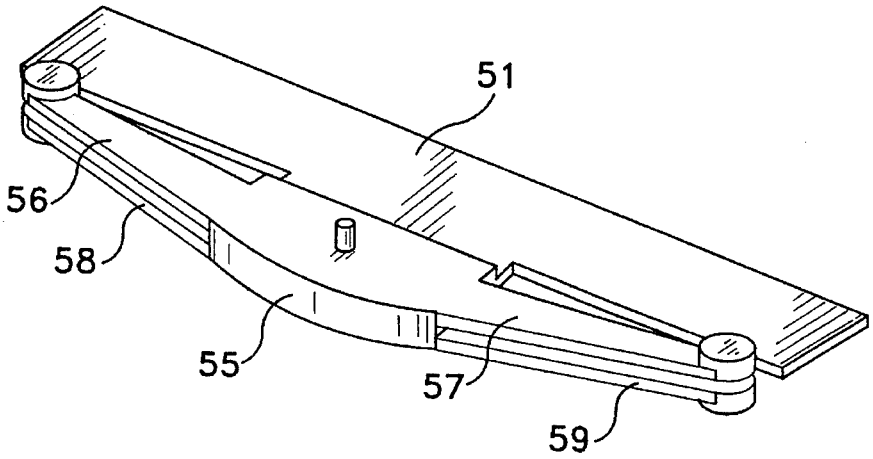
FIG. 2 is a perspective view of a cleaning member used with the embodiment shown in FIG. 1.

The present invention is directed to a razor head having at least one dynamically movable skin-engaging element and a cleaning member for dislodging shaving debris from a space created in part by that movable element. The embodiment of the present invention illustrated in FIGS. 1–4 comprises a razor head having two movable blades separated by a forward projection of a cleaning member. As used herein, the term "razor head" is meant to include cartridges which are designed and manufactured for attachment to a separate razor, as well as the operative portion of a disposable razor wherein the skin-engaging portions are integrally formed with a handle section.

With reference to FIGS. 1–5, this illustrated embodiment comprises a blade support structure comprising a cap 10, a guard section 20, and side walls 25. The blade support structure is most preferably formed as a single, integrally-molded element, for example, by injection molding. A seat blade 30, a cap blade 40, and cleaning member 50 are supported by the support structure and maintained within the support structure by retainer 60. The present design advantageously permits cap blade 40 and seat blade 30 to be supported by the side walls 25 of the support structure for forward and rearward movement.

Cleaning member 50 comprises a forward projection 51 connected to an actuator 55 from which depend upper spring fingers 56, 57 and lower spring fingers 58, 59. According to the illustrated preferred embodiment of the present invention, the entire cleaning member 50 is formed as an integral unit, most preferably from a thermoplastic material which can be injection-molded. Suitable materials should have sufficient resiliency, corrosion resistance, creep resistance, spring qualities and lubricity under conditions typically encountered during the life of the razor head include. For example, an acetal copolymer sold under the name CELCON™ by Hoechst Celanese is suitable. The illustrated spring fingers are positioned to the sides of actuator 55 and above and below forward projection 51. In this manner, the spring fingers will be properly aligned for forwardly contacting the cap blade 40 and seat blade 30.

According to this illustrated embodiment of the present invention, the inner portions of side walls 25 of the support structure are formed with inwardly-projecting protrusions 27 designed to limit the forward and rearward movement of the blades. As illustrated, cap blade 40 comprises a pair of notches 42 located on the sides of blade 40. Notches 42 are designed to allow blade 40 to slide rearwardly and forwardly to an extent which is limited by the engagement of protrusions 27 with the forward and rearward walls of notches 42. In a similar manner, seat blade 30 is provided with notches 32 which are also designed to engage inwardly projecting protrusions 27. According to this embodiment of the present invention, the razor head is preferably assembled in an upside-down manner. After the support structure is formed, it is placed in an inverted position. The notches 42 of cap blade 40 are then aligned to slide over projections 27 and cap blade 40 is lowered into the support structure. Cleaning member 50 is then positioned by aligning upwardly projecting peg 52 with a complementary receptacle 12 formed in the underside of cap 10. Receptacle 12 is designed to receive peg 52 in a manner which permits cleaning member 50 to move forwardly and rearwardly while peg 52 is guided within receptacle 12. After cleaning member 50 has been positioned, seat blade 30 is also lowered into the support structure with notches 32 aligned with protrusions 27. The operative assembly is then maintained in position by retainer 60 which may be press-fit or snap-fit into the support structure. According to the illustrated embodiment, side projection 62 of retainer 60 are designed to snap into complementary recesses 22 formed on the interior sides of side walls 25. Furthermore, in order to maintain the illustrated twin blade package securely within the support structure, retainer 60 is also provided with upwardly extending biasing members 65 which serve to bias the blades and cleaning member upwardly toward the cap 10 thereby reducing any adverse effects caused by manufacturing tolerances which could cause undesired movement of the skin-engaging elements during shaving.

From the present description, it will be appreciated that the illustrated spring fingers of cleaning member 50 provide a pre-loaded, forwardly-directed force on the movable blades which must be overcome by the forces exerted on the blades during shaving before these blades will move rearwardly. The magnitude of this pre-loaded force can be changed during the manufacture of the razor head of the present invention. For example, the force required to move a blade can be changed by using more or less resilient material in forming the cleaning member 50. Alternatively, the shape of the spring fingers can be changed to increase or decrease the magnitude of the pre-loaded force. For example, the shape and/or dimensions of each spring finger can be changed. The spring fingers illustrated in the embodiment shown in FIG. 6 comprises smaller spring fingers designed to offer relatively less resistance than the spring fingers shown in FIG. 2 to the rearwardly urged skin-engaging elements during shaving due to their smaller size.

While the embodiment illustrated in FIGS. 1–5 of the present invention comprises blades which move rearwardly in response to forces encountered during shaving, it is also within the scope of the present invention to provide a razor head having the advantages of the present invention including a cleaning member integrally formed with at least one biasing member, while providing one or more skin-engaging elements which move downwardly in response to forces encountered during shaving. It is also within the scope of the present invention to provide a cleaning member having an integrally formed biasing member for biasing a skin-engaging element other than a blade. For example, a guard member or a cap may be resiliently biased by the biasing member formed on the cleaning member. Further, it is within the scope of the present invention to provide a shaving aid 15 on the cap.

Figure 3:
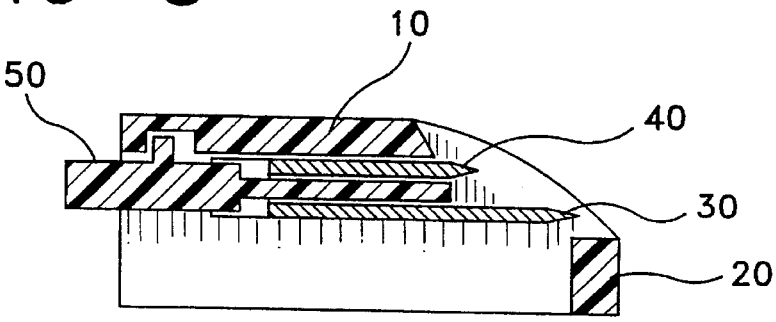
FIG. 3 is a cross-sectional along lines 3—3 of FIG. 1.
Figure 4:
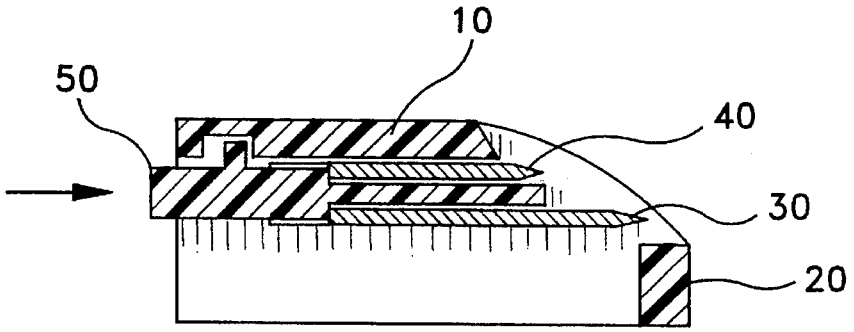
FIG. 4 is also a cross-sectional view, similar to FIG. 3, but with the cleaning member in the forward-actuated position.
Figure 5:
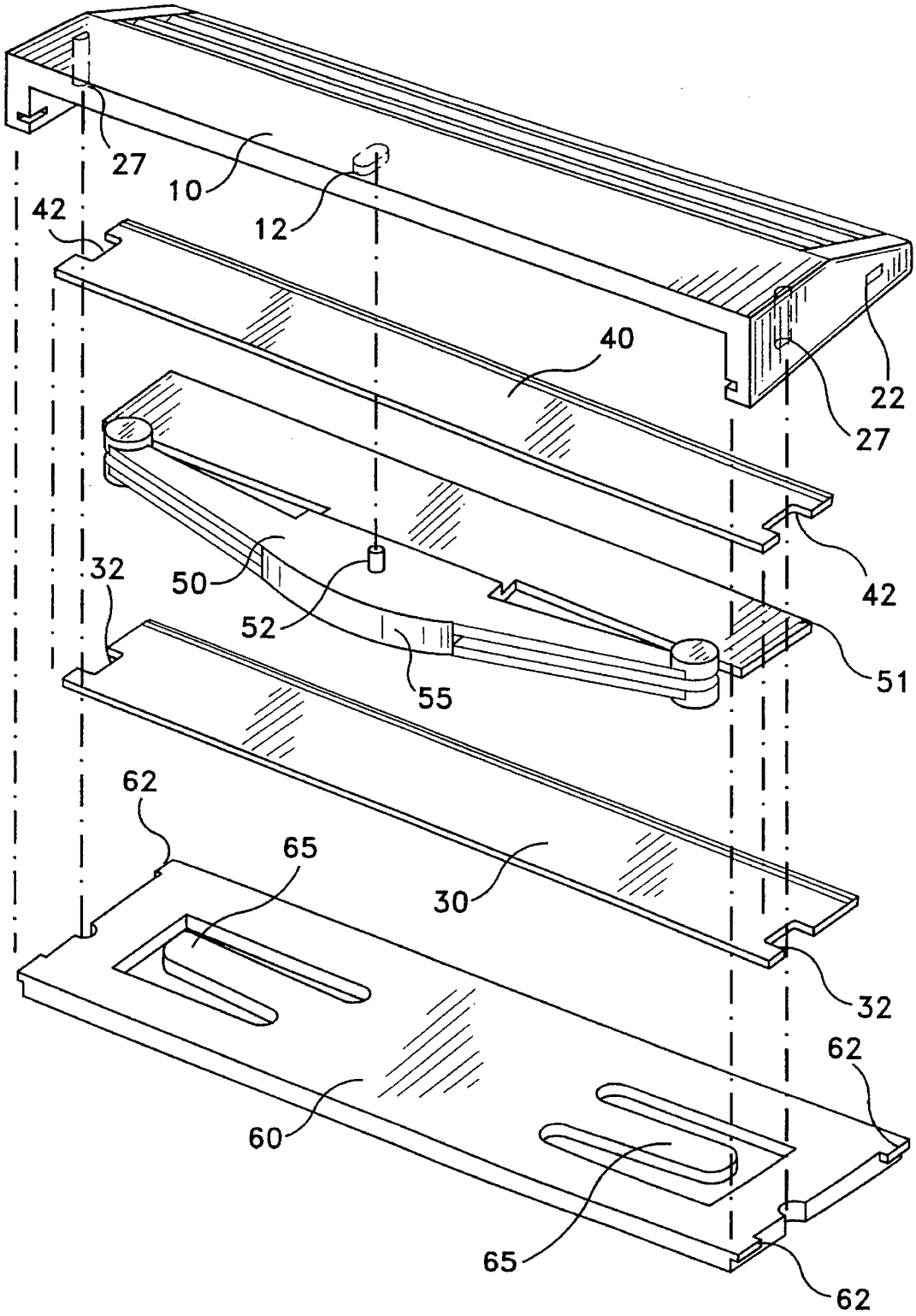
FIG. 5 is a partial-exploded view of the razor head shown in FIG. 1

FIG. 3 illustrates the retracted "home" position of cleaning member 50 while FIG. 4 illustrates the cleaning member in the forward, actuated position. FIG. 5 is a partial, exploded view of the razor head shown in FIG. 1. Those skilled in the art will appreciate that the movement of a skin-engaging element can be restricted in other ways without departing from the scope of the present invention.

Figure 6:
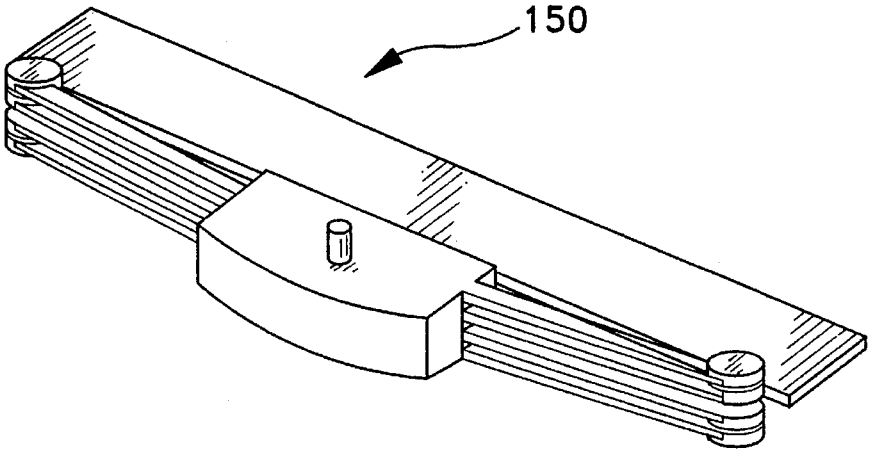
FIG. 6 is a perspective view of a cleaning member of an alternative embodiment of the present invention.
Figure 7:
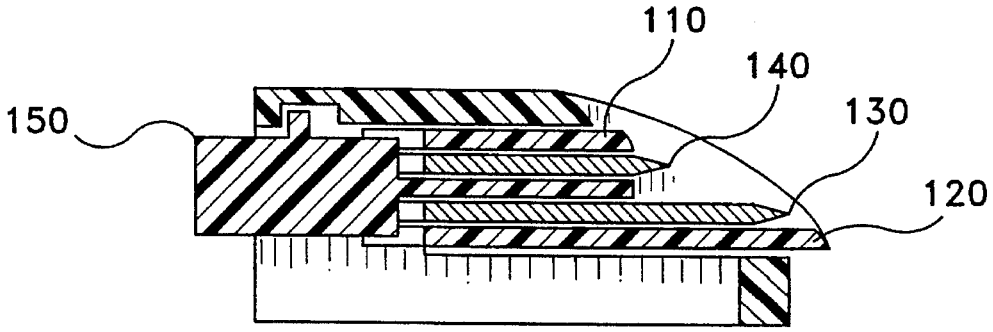
FIG. 7 is a cross-sectional view of a razor head utilizing the cleaning member shown in FIG. 6.

According to another embodiment of the present invention shown in FIGS. 6 and 7, a cleaning member 150 comprises four sets of spring fingers. The centrally positioned spring fingers perform functions similar to those shown in the embodiments of FIGS. 1–5. In order to reduce the magnitude of the pre-loaded, forwardly-directed pressure exerted on the skin-engaging elements, the spring fingers shown in the embodiment of FIGS. 6 and 7 are relatively smaller than the spring fingers shown in FIG. 2. In addition to the two centrally located of pairs of spring fingers, cleaning member 150 is provided with two additional sets of spring fingers. One pair is located above and one pair is positioned below the spring fingers which bias the blades. As illustrated in FIG. 7, the additional pairs of spring fingers are positioned to contact a movable guard bar 120 and a movable cap member 110. According to this illustrated embodiment of the present invention, each of cap member 110, cap blade 140, seat blade 130, and guard member 120 may move independently of the other movable, skin-engaging elements in response to forces encountered during shaving.

It will therefore be appreciated that this embodiment of the present invention advantageously provides a dynamic razor head having a plurality of movable blades, a movable cap member and a movable guard bar designed to move in response to the forces encountered during shaving and to be returned to their "home" position by the resilient fingers of a cleaning member when the shaving forces are removed.

The various embodiments of the present invention also provide simple and efficiently manufactured dynamic razor heads which provide a person shaving with a mechanism for removing the shaving debris which tends to accumulate in small spaces on the razor head during shaving.

While the illustrated embodiments of the present invention comprise a cleaning member having a forward projection which extends between two, independently-movable blades, it is also within the scope of the present invention to provide a cleaning member having one or more projections which are positioned to remove shaving debris from other spaces in the razor head. For example, a cleaning member projection may extend between a movable guard bar and a fixed blade, i.e., a non-movable blade. It is also not necessary that one or more of the blades move in order to obtain the benefits of the present invention since it may be desirable to form a razor head having fixed blades with a movable guard member and/or a movable cap member. In such cases, the advantages of the present invention wherein a cleaning member is integrally formed with at least one biasing member would have equally advantageous application.

What is claimed is:

1. A razor head comprising:

a blade support structure comprising side walls;

at least one movable skin-engaging element supported for movement in response to forces encountered during shaving and biased to a first position;

a movable cleaning member for removing shaving debris from said razor head, said cleaning member comprising means for biasing said movable skin-engaging element to said first position wherein said biasing means contacts said skin-engaging element and urges said skin-engaging element to said first position;

wherein said razor head comprises at least two blades disposed in spaced relation and defining a space therebetween; and wherein said cleaning member comprises a projection which extends into said space and wherein said cleaning member further comprises an actuator portion which is connected to said projection so that when said actuator portion is moved, said projection moves within said space;

and further wherein said biasing means comprise at least one spring finger and said spring finger comprises a first end connected to said actuator portion and a second end which contacts said movable skin-engaging element.

2. A razor head according to claim 1 wherein said movable skin-engaging element comprises a guard member.

3. A razor head comprising:

a blade support structure comprising side walls;

at least one movable skin-engaging element supported for movement in response to forces encountered during shaving and biased to a first position;

a movable cleaning member for removing shaving debris from said razor head, said cleaning member comprising means for biasing said movable skin-engaging element to said first position wherein said biasing means contacts said skin-engaging element and urges said skin-engaging element to said first position; and wherein said movable skin-engaging element comprises a movable blade having a forward cutting edge and at least one relieved section, said blade support structure comprises a retention member which is received within said relieved section for limiting the movement of said movable blade.

4. A razor head according to claim 3 wherein said relieved section comprises a notch in one side of said movable blade.

5. A razor head according to claim 3 wherein said relieved section comprises a slot in said movable blade which receives a fixed pin for limiting the movement of said movable blade.

6. A razor head comprising:

a blade support structure comprising side walls;

at least one movable skin-engaging element supported for movement in response to forces encountered during shaving and biased to a first position;

a movable cleaning member for removing shaving debris from said razor head, said cleaning member comprising means for biasing said movable skin-engaging element to said first position wherein said biasing means contacts said skin-engaging element and urges said skin-engaging element to said first position; and wherein said at least one movable skin-engaging element comprises a plurality of movable blades and said cleaning member comprises a plurality of spring fingers which contact said blades.

7. A razor head comprising:

a blade support structure comprising side walls;

at least one movable skin-engaging element supported for movement in response to forces encountered during shaving and biased to a first position;

a movable cleaning member for removing shaving debris from said razor head, said cleaning member comprising means for biasing said movable skin-engaging element to said first position wherein said biasing means contacts said skin-engaging element and urges said skin-engaging element to said first position; and wherein said movable skin-engaging element comprises a cap member.

8. A razor head according to claim 7 wherein said razor head comprises a shaving aid on said cap member.

9. A razor head comprising:

a support structure;

at least one movable skin-engaging element supported for movement in response to forces encountered during shaving and biased to a first position movable relative to said support structure;

a cleaning member comprising an actuator, a movable projection, and at least one biasing member which biases said at least one movable skin-engaging element in a first direction while urging said cleaning member in another direction;

and wherein said movable skin-engaging element comprises a cap member.

10. A razor head according to claim 9 wherein said cleaning member comprises a thermoplastic material.

11. A razor head according to claim 9 wherein said at least one movable skin-engaging element comprises two blades movable in response to forces encountered during shaving.

12. A razor head according to claim 9 further comprising a movable guard member.

13. A razor head according to claim 9 further comprising a movable cap member.

14. A razor head according to claim 9 wherein said razor head comprises at least two blades disposed in spaced relation and defining a space therebetween; and wherein said movable projection extends into said space.

15. A razor head according to claim 9 wherein said movable skin-engaging element comprises a guard member.

* * * * *